US010487292B2

(12) United States Patent
Saveyn et al.

(10) Patent No.: US 10,487,292 B2
(45) Date of Patent: Nov. 26, 2019

(54) FABRIC ENHANCER COMPOSITION

(71) Applicant: The Procter & Gamble Company, Cincinnati, OH (US)

(72) Inventors: Pieter Jan Maria Saveyn, Heusden (BE); Dries Vaes, Houtvenne (BE); Marc Johan Declercq, Strombeek-bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 80 days.

(21) Appl. No.: 15/682,587

(22) Filed: Aug. 22, 2017

(65) Prior Publication Data

US 2018/0057772 A1 Mar. 1, 2018

Related U.S. Application Data

(60) Provisional application No. 62/381,729, filed on Aug. 31, 2016.

(51) Int. Cl.

| | |
|---|---|
| ***C11D 3/50*** | (2006.01) |
| ***C11D 1/835*** | (2006.01) |
| ***C11D 3/00*** | (2006.01) |
| ***C11D 3/20*** | (2006.01) |

(Continued)

(52) U.S. Cl.

CPC ..... *C11D 1/835* (2013.01); *C11D 3/001* (2013.01); *C11D 3/0015* (2013.01); *C11D 3/2003* (2013.01); *C11D 3/2006* (2013.01); *C11D 3/2065* (2013.01); *C11D 3/2068* (2013.01); *C11D 3/50* (2013.01); *C11D 3/502* (2013.01); *C11D 3/505* (2013.01); *C11D 1/62* (2013.01); *C11D 1/72* (2013.01)

(58) Field of Classification Search

CPC ..... C11D 3/001; C11D 1/62; C11D 3/0015

See application file for complete search history.

(56) References Cited

U.S. PATENT DOCUMENTS 5,368,756 A * 11/1994 Vogel ..... C11D 1/62 510/499
6,413,920 B1 7/2002 Bettiol et al.
7,686,892 B2 3/2010 Smets et al.

(Continued)

FOREIGN PATENT DOCUMENTS

DE 102007021792 A1 11/2008
DE 102007021792 A1 11/2008

(Continued)

OTHER PUBLICATIONS

ASTM Designation: D3954-94; Standard Test Method for Dropping Point of Waxes; 2 pages.

(Continued)

*Primary Examiner* — John R Hardee
(74) *Attorney, Agent, or Firm* — Gregory S. Darley-Emerson

(57) ABSTRACT

The present invention relates to fabric enhancer compositions as well as the methods of making and using same. Such fabric enhancer compositions comprise a quaternary ammonium ester fabric softening active, a branched, ethoxylated nonionic surfactant and perfume. Such fabric enhancer compositions exhibit improved freeze-thaw stability while also delivering the softening benefits that are desired by consumers.

16 Claims, 3 Drawing Sheets

(51) Int. Cl.

| | |
|---|---|
| *C11D 1/62* | (2006.01) |
| *C11D 1/72* | (2006.01) |

(56) References Cited

U.S. PATENT DOCUMENTS

| | | | |
|---|---|---|---|
| 8,247,364 | B2 | 8/2012 | Sadlowski et al. |
| 8,765,659 | B2 | 7/2014 | Gizaw et al. |
| 2005/0003980 | A1 | 1/2005 | Baker et al. |
| 2007/0275866 | A1 | 11/2007 | Dykstra |
| 2013/0109612 | A1 | 5/2013 | Corona, III et al. |

FOREIGN PATENT DOCUMENTS

| | | | |
|---|---|---|---|
| EP | 0128231A1 | A1 | 12/1984 |
| EP | 0280550A2 | A2 | 8/1988 |
| EP | 0335404A2 | A2 | 10/1989 |
| EP | 2196527A1 | A1 | 6/2010 |
| WO | WO9319147 | A1 | 9/1993 |
| WO | WO0196510 | A1 | 12/2001 |
| WO | WO2006133791 | A2 | 12/2006 |
| WO | WO2012052349 | A1 | 4/2012 |

OTHER PUBLICATIONS

International Search Report; International Application No. PCT/US2017/048117; dated Nov. 7, 2017; 17 pages.

Leo, A.; Methods of Calculating Partition Coefficients; Comprehensive Medicinal Chemistry; vol. 4; C. Hansch; P. G. Sammens; J.B. Taylor; and C.A. Ramsden, Eds.; p. 295; Pergamon Press; 1990.

* cited by examiner

Figure 1: Apparatus A

Figure 3: Apparatus B
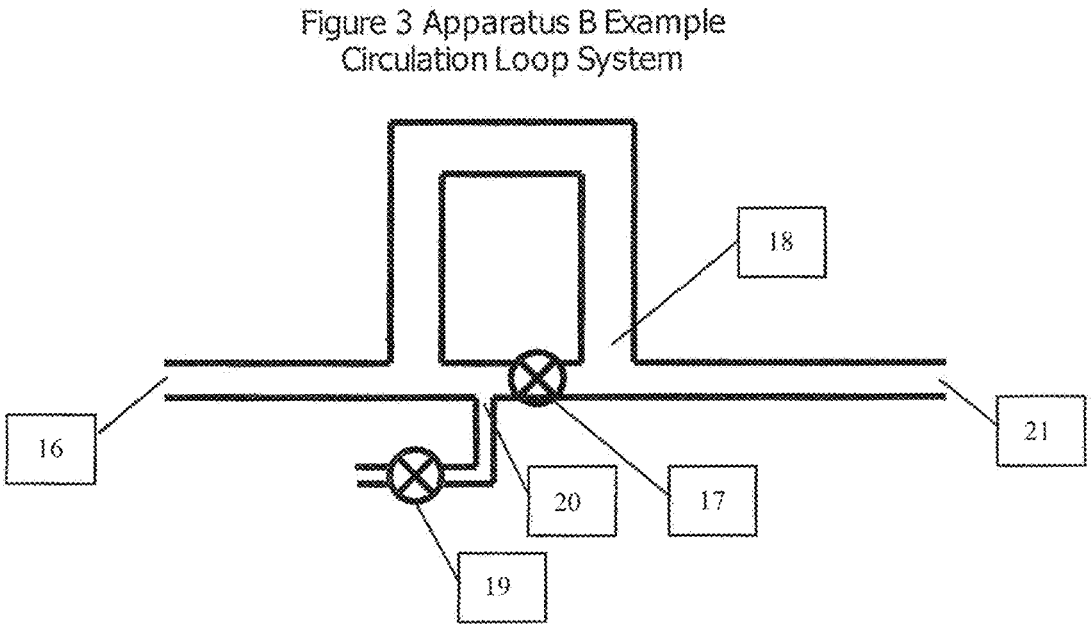

FABRIC ENHANCER COMPOSITION

FIELD OF THE INVENTION

The present invention relates to fabric enhancer compositions as well as the methods of making and using same.

BACKGROUND OF THE INVENTION

Liquid fabric enhancers comprising quaternary ammonium ester softening actives can exhibit freeze-thaw instability that typically results in product gelling. While certain solutions to such instability have been proposed, such solutions are not entirely acceptable as they give rise to other issues such as increased formulation complexity and cost. Furthermore, such solutions do not work universally for a broad set of different liquid fabric enhancer compositions. As such, greater formulation effort is needed when reformulating fabric enhancer compositions, in order to ensure they remain freeze-thaw stable. Applicants recognized that the source of the problem was rooted in the disruption of the quaternary ammonium ester vesicles during the freeze thaw cycle which results in the formation of lamellar sheets that induce a dramatic viscosity increase. The increased viscosity is typically so dramatic that the product is no longer fit for use. The freeze-thaw instability is particularly pronounced in the presence of perfume. While not being bound by theory, Applicants believe that in order to provide a universal solution to the aforementioned problem, a nonionic surfactant comprising a hydrophobic moiety and hydrophilic moiety that universally results in a sufficient balanced interaction with the quaternary ammonium ester vesicles is required to inhibit the aforementioned transition from vesicles to lamellar sheets. Thus, Applicants disclose liquid fabric enhancer formulations that have a freeze-thaw stability over a broad range of liquid fabric enhancer actives.

SUMMARY OF THE INVENTION

The present invention relates to fabric enhancer compositions as well as the methods of making and using same. Such fabric enhancer compositions comprise a quaternary ammonium ester fabric softening active, a branched, ethoxylated nonionic surfactant, perfume, and an alcohol. Such fabric enhancer compositions exhibit improved freeze-thaw stability while also delivering the softening and freshness benefits that are desired by consumers.

The inventors have found that the composition of the invention could exhibit good softening performance, good storage stability and/or good viscosity.

DETAILED DESCRIPTION OF THE INVENTION

Definitions

Figure 1:
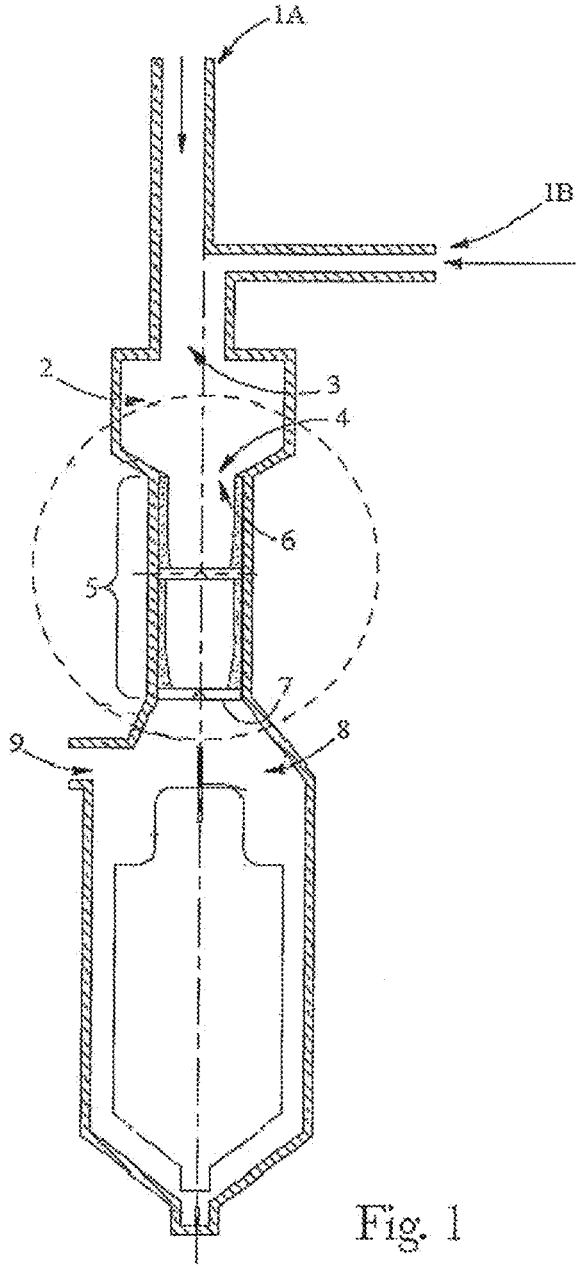
FIG. 1 details the apparatus A used in the process of the present invention
Figure 2:
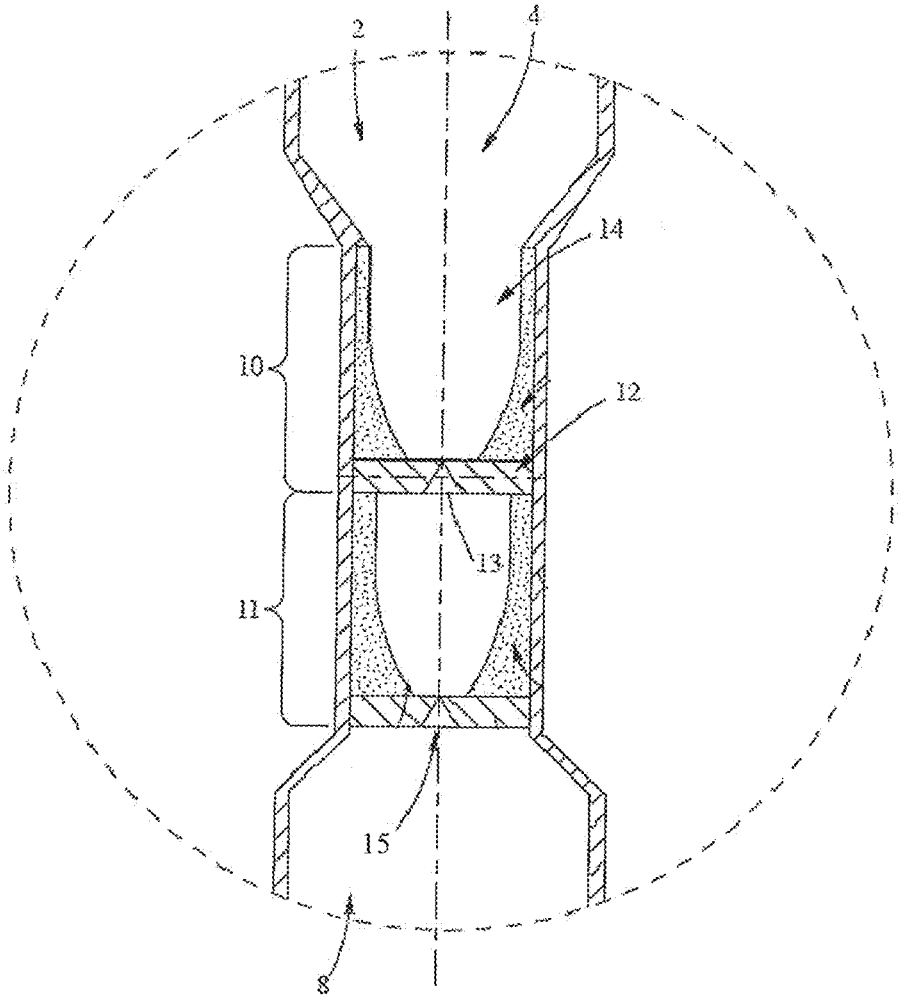
FIG. 2 details the orifice component 5 of the apparatus used in the method of the present invention FIG. 3 details the apparatus B used in the process of the present invention

As used herein, the phrase "benefit agent containing delivery particle" encompasses microcapsules including perfume microcapsules.

As used herein, the articles including "a" and "an" when used in a claim, are understood to mean one or more of what is claimed or described.

As used herein, the terms "include", "includes" and "including" are meant to be non-limiting.

The test methods disclosed in the Test Methods Section of the present application should be used to determine the respective values of the parameters of Applicants' inventions.

Unless otherwise noted, all component or composition levels are in reference to the active portion of that component or composition, and are exclusive of impurities, for example, residual solvents or by-products, which may be present in commercially available sources of such components or compositions. For example, it is known that quaternary ammonium esters typically contain the following impurities: the monoester form of the quaternary ammonium ester, residual non-reacted fatty acid, and non-quaternized esteramines.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The Fabric Enhancer Composition and Method of Use

I. A fabric enhancer composition having a viscosity of from 20 cP to 700 cP, preferably 40 cP to 600 cP, more preferably 60 cP to 400 cP and a pH of from about 1 to about 5, preferably from about 2 to about 4, said fabric enhancer composition comprising, based on total composition weight:

a) from about 3% to about 20%, preferably from about 4% to about 15%, more preferably from about 6% to about 12% of a quaternary ammonium ester fabric softening active;

b) from about 0.01% to about 30%, from about 0.1% to about 30%, more preferably from about 0.5% to about 15%, more preferably from about 1% to about 10%, most preferably from about 2% to about 9% of an alcohol comprising from 1 to 7 carbons, preferably said alcohol is selected from the group consisting of a mono alcohol, polyol and mixtures thereof; more preferably said alcohol is selected from the group consisting of ethanol, isopropanol, glycerol, ethylene glycol, propanediol, sorbitol and mixtures thereof; most preferably, said alcohol is selected from the group consisting of glycerol, ethylene glycol, propanediol, sorbitol and mixtures thereof; and c) from about 0.1% to about 10% of a perfume delivery system and/or from about 0.1% to about 4% perfume d) a surfactant having Formula A and/or B:

Formula A

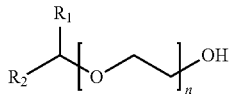

wherein n is on average from about 30 to 85, preferably from about 30-70, more preferably from about 30-60, most preferably from about 30 to 45; $R_1$ is hydrogen or an alkyl group comprising from 1 to 21 carbons; $R_2$ is an alkyl chain comprising from 1 to 22 carbon atoms, with the proviso that the sum of the total number of carbon atoms of $R_1$ and $R_2$ is from 9 to 22;

preferably, $R_1$ is an alkyl group comprising from 1 to 21 carbons; $R_2$ is an alkyl chain comprising from 1 to 22 carbon atoms, with the proviso that the sum of the total number of carbon atoms of $R_1$ and $R_2$ is from 9 to 22;

Formula B

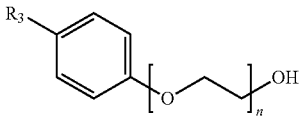

wherein n is on average from about 30 to 85, preferably from about 30-70, more preferably from about 30-60, most preferably from about 30 to 50; $R_3$ is a linear or branched alkyl chain comprising from 9 to 22 carbon atoms preferably, n on average is 30 and $R_3$ is a branched alkyl chain comprising 9 carbon atoms the ratio of quaternary ammonium ester softener active to nonionic surfactant being 1:1 to 7:1, more preferably 2:1 to 13:2;

preferably said fabric enhancer composition comprises, based on total composition weight, from 1.1% to about 5%, more preferably from 1.2% to about 3%, most preferably from 1.2% to about 2% of said nonionic surfactant.

is disclosed.

Examples of suitable commercially quaternary ammonium ester fabric softening actives are available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

Examples of suitable commercially available nonionic ethoxylated surfactants with the structure of Formula A are available from The Dow Chemical Company under the trade name Tergitol™ 15-s-30 and Tergitol™ 15-s-40, from Clariant under trade name Genapol X307 and Genapol X407. Examples of suitable commercially available nonionic ethoxylated surfactants with the structure of Formula B are available from The Dow Chemical Company under the trade name Tergitol™ NP-30, Tergitol™ NP-40, Tergitol™ NP-50, Tergitol™ NP-55, Tergitol™ NP-70.

II. A fabric enhancer composition according to Paragraph I wherein said fabric softening active quaternary ammonium ester has the following formula:

$$\{R^2_{4-m}—N^+—[X—Y—R^1]_m\}A^-$$

wherein:

m is 1, 2 or 3 with proviso that the value of each m is identical;

each $R^1$ is independently hydrocarbyl, or substituted hydrocarbyl group;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently $(CH_2)n$, $CH_2$—$CH(CH_3)$— or CH—$(CH_3)$—$CH_2$— and each n is independently 1, 2, 3 or 4, preferably each n is 2;

each Y is independently —O—(O)C— or —C(O)—O—;

A− is independently selected from the group consisting of chloride, methylsulfate, ethylsulfate, and sulfate, preferably A− is selected from the group consisting of chloride and methyl sulfate;

with the proviso that the sum of carbons in each $R^1$, when Y is —O—(O)C—, is from 13 to 21, preferably the sum of carbons in each $R^1$, when Y is —O—(O)C—, is from 13 to 19.

III. A fabric enhancer composition according to any of Paragraphs I-II wherein said quaternary ammonium ester fabric softening active comprises a fatty acid moiety comprising 12 to 22 carbons, said quaternary ammonium esters being selected from the group consisting of:

a) bis-(2-hydroxypropyl)-dimethylammonium methylsulfate fatty acid ester;

b) isomers of bis-(2-hydroxypropyl)-dimethylammonium methylsulfate fatty acid ester;

c) N,N-bis(hydroxyethyl)-N,N-dimethyl ammonium chloride fatty acid ester;

d) N,N-bis(hydroxyethyl)-N,N-dimethyl ammonium methylsulfate fatty acid ester; and e) N,N,N-tri(2-hydroxyethyl)-N-methyl ammonium methylsulfate fatty acid ester;

said quaternary ammonium ester fabric softening active's fatty acid ester moiety being saturated or unsaturated, and substituted or unsubstituted.

IV. A fabric enhancer composition according to any of Paragraphs I-III wherein said quaternary ammonium ester fabric softening active is:

a) saturated, substituted and of animal origin;

b) saturated, substituted and of vegetable origin;

c) saturated, unsubstituted and of animal origin;

d) saturated, unsubstituted and of vegetable origin;

e) unsaturated, substituted and of animal origin;

f) unsaturated, substituted and of vegetable origin;

g) unsaturated, unsubstituted and of animal origin; or h) unsaturated, unsubstituted and of vegetable origin preferably said quaternary ammonium ester fabric softening active has an iodine value from 0 to about 60, more preferably from about 10 to about 55, most preferably from about 15 to about 45.

V. A fabric enhancer composition according to any of Paragraphs I-IV wherein said quaternary ammonium ester fabric softening active has the following formula:

$$\{[R^2]_2N^+[CH_2—CH(CH_3)—O—C(=O)—R^1]_2\}A^-$$

wherein each $R^2$ is independently hydrogen, a short chain $C_1$-$C_6$ alkyl, $C_1$-$C_3$ hydroxyalkyl group, a poly($C_{2-3}$ alkoxy), benzyl, or mixtures thereof, wherein each $R^1$ is independently a hydrocarbyl group or substituted hydrocarbyl group comprising about 11 to about 21 carbon atoms, and wherein $A^-$ is selected from the group consisting of chloride and methylsulfate.

VI. A fabric enhancer composition according to any Paragraphs I-V, wherein said perfume delivery system is selected from the group consisting of benefit agent delivery particles, pro-perfumes, polymer particles, functionalized silicones, polymer assisted delivery, molecule assisted delivery, fiber assisted delivery, amine assisted delivery, cyclodextrins, starch encapsulated accord, zeolite and inorganic carrier, and mixtures thereof; preferably said perfume delivery system comprises benefit agent containing delivery particles, more preferably said perfume delivery system comprises two or more types of benefit agent containing delivery particles.

VII. A fabric enhancer composition according to any Paragraphs I-VI comprising an adjunct material.

VIII. A method of treating and/or cleaning a fabric, said method comprising a) optionally washing, rinsing and/or drying said fabric;

b) contacting said fabric with a fabric enhancer composition according to any Paragraphs I-VII and c) optionally washing, rinsing and/or drying said fabric wherein said drying steps comprise active drying and/or passive drying.

Use of Surfactant

Use of a surfactant having Formula A and/or B:

Formula A

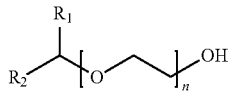

wherein n is on average from about 30 to 85, preferably from about 30-70, more preferably from about 30-60, most preferably from about 30 to 50; $R_1$ is hydrogen or an alkyl group comprising from one to twenty one carbons; $R_2$ is an alkyl chain comprising from 1 to 22 carbon atoms, with the proviso that the sum of the total number of carbon atoms of $R_1$ and $R_2$ is from 9 to 22; preferably, n on average is 30 and the number of carbon atoms in both $R_1$ and $R_2$ is greater than 1;

Formula B

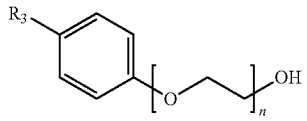

wherein n is on average from about 30 to 85, preferably from about 30-70, more preferably from about 30-60, most preferably from about 30 to 50; $R_3$ is a linear or branched alkyl chain comprising from 9 to 22 carbon atoms; preferably, n on average is 30 and $R_3$ is a branched alkyl chain comprising 9 carbon atoms to improve the freeze than stability of a fabric enhancer composition is disclosed.

Adjunct Ingredients

The fabric enhancer composition may comprise adjunct ingredients suitable for use in the instant compositions and may be desirably incorporated in certain aspects of the invention, for example to assist or enhance treatment of the substrate, or to modify the aesthetics of the composition as is the case with perfumes, colorants, dyes or the like. The precise nature of these additional components, and levels of incorporation thereof, will depend on the physical form of the composition and the nature of the fabric treatment operation for which it is to be used. Suitable adjunct materials include, but are not limited to, additional softener actives, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, hueing dyes, perfumes, perfume delivery systems, structure elasticizing agents, carriers, structurants, hydrotropes, processing aids, solvents and/or pigments.

As stated, the adjunct ingredients are not essential to Applicants' compositions. Thus, certain aspects of Applicants' compositions do not contain one or more of the following adjuncts materials: additional softener actives, surfactants, builders, chelating agents, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, hueing dyes, perfumes, perfume delivery systems structure elasticizing agents, carriers, hydrotropes, processing aids, solvents and/or pigments. However, when one or more adjuncts are present, such one or more adjuncts may be present as detailed below.

Additional Fabric Softening Active

The fluid fabric enhancer composition of the present invention may comprise from 0% to 10%, preferably from 0.1% to 10%, more preferably from 0.1% to 5% of additional fabric softening active ("FSA"). Suitable fabric softening actives, include, but are not limited to, materials selected from the group consisting of non-ester quaternary ammonium compounds, amines, fatty esters, sucrose esters, silicones, dispersible polyolefins, polysaccharides, fatty acids, softening oils, polymer latexes and combinations thereof.

Non-Ester Quaternary Ammonium Compounds

The fabric softening active may comprise compounds of the formula:

$$[R_{4-m}—N^+—R^1_m]X^-$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, poly($C_{2-3}$ alkoxy), polyethoxy, benzyl, or mixtures thereof; each m is 2 or 3; the sum of carbons in each $R^1$ may be $C_{12}$-$C_{22}$, with each $R^1$ being a hydrocarbyl, or substituted hydrocarbyl group; and $X^-$ may comprise any softener-compatible anion. The softener-compatible anion may comprise chloride, bromide, methylsulfate, ethylsulfate, sulfate, and nitrate. The softener-compatible anion may comprise chloride or methyl sulfate.

Non-limiting examples include dialkylenedimethylammonium salts such as dicanoladimethylammonium chloride, di(hard)tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

Amines

The fabric enhancer composition may comprise a fabric softener active comprising amine.

Suitable amines include but are not limited to, materials selected from the group consisting of amidoesteramines, amidoamines, imidazoline amines, alkyl amines, amdioester amines and mixtures thereof. Suitable ester amines include but are not limited to, materials selected from the group consisting of monoester amines, diester amines, triester amines and mixtures thereof. Suitable amido quats include but are not limited to, materials selected from the group consisting of monoamido amines, diamido amines and mixtures thereof. Suitable alkyl amines include but are not limited to, materials selected from the group consisting of mono alkylamines, dialkyl amines quats, trialkyl amines, and mixtures thereof.

Polysaccharides

The fabric enhancer composition may comprise a fabric softener active comprising polysaccharide.

The polysaccharide may comprise cationic starch. the fabric enhancer compositions may comprise cationic starch at a level of from about 0.1% to about 7%, alternatively from about 0.1% to about 5%, alternatively from about 0.3% to about 3%, and alternatively from about 0.5% to about 2.0%, by weight of the composition. Suitable cationic starches for use in the present compositions are commercially-available from Cerestar under the trade name C*BOND® and from National Starch and Chemical Company under the trade name CATO® 2A.

Sucrose Esters

The fabric enhancer composition may comprise fabric softener active comprising sucrose esters.

Sucrose esters are typically derived from sucrose and fatty acids. Sucrose ester is composed of a sucrose moiety having one or more of its hydroxyl groups esterified.

Sucrose is a disaccharide having the following formula:

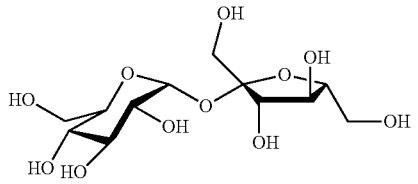

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8−x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are $C_{18}$, alternatively greater than about 50% of the linear chains are $C_{18}$, alternatively greater than about 80% of the linear chains are $C_{18}$.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation. In the case where a higher IV is preferred, such as from about 40 to about 95, then oleic acid and fatty acids derived from soybean oil and canola oil are the starting materials.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

Polyolefins

The fabric enhancer composition may comprise fabric softener active comprising dispersible polyolefins.

Polyolefins can be in the format of waxes, emulsions, dispersions or suspensions. Non-limiting examples are discussed below.

The polyolefin is chosen from a polyethylene, polypropylene, or a combination thereof. The polyolefin may be at least partially modified to contain various functional groups, such as carboxyl, alkylamide, sulfonic acid or amide groups. The polyolefin is at least partially carboxyl modified or, in other words, oxidized.

For ease of formulation, the dispersible polyolefin may be introduced as a suspension or an emulsion of polyolefin dispersed by use of an emulsifying agent. The polyolefin suspension or emulsion may comprise from about 1% to about 60%, alternatively from about 10% to about 55%, alternatively from about 20% to about 50% by weight of polyolefin. The polyolefin may have a wax dropping point (see ASTM D3954-94, volume 15.04—"Standard Test Method for Dropping Point of Waxes") from about 20° to about 170° C., alternatively from about 50° to about 140° C. Suitable polyethylene waxes are available commercially from suppliers including but not limited to Honeywell (A-C polyethylene), Clariant (Velustrol® emulsion), and BASF (LUWAX®).

When an emulsion is employed with the dispersible polyolefin, the emulsifier may be any suitable emulsification agent. Non-limiting examples include an anionic, cationic, nonionic surfactant, or a combination thereof. However, almost any suitable surfactant or suspending agent may be employed as the emulsification agent. The dispersible polyolefin is dispersed by use of an emulsification agent in a ratio to polyolefin wax of about 1:100 to about 1:2, alternatively from about 1:50 to about 1:5, respectively.

Latexes

The fabric enhancer composition may comprise fabric softener active comprising polymer latexes.

Polymer latex are typically made by an emulsion polymerization which includes one or more monomers, one or more emulsifiers, an initiator, and other components familiar to those of ordinary skill in the art. Generally, all polymer latexes that provide fabric care benefits can be used as water insoluble fabric care benefit agents of the present invention. Additional non-limiting examples include the monomers used in producing polymer latexes such as: (1) 100% or pure butylacrylate; (2) butylacrylate and butadiene mixtures with at least 20% (weight monomer ratio) of butylacrylate; (3) butylacrylate and less than 20% (weight monomer ratio) of other monomers excluding butadiene; (4) alkylacrylate with an alkyl carbon chain at or greater than $C_6$; (5) alkylacrylate with an alkyl carbon chain at or greater than $C_6$ and less than 50% (weight monomer ratio) of other monomers; (6) a third monomer (less than 20% weight monomer ratio) added into an aforementioned monomer systems; and (7) combinations thereof.

Polymer latexes that are suitable fabric care benefit agents in the present invention may include those having a glass transition temperature of from about −120° C. to about 120° C., alternatively from about −80° C. to about 60° C. Suitable emulsifiers include anionic, cationic, nonionic and amphoteric surfactants. Suitable initiators include initiators that are suitable for emulsion polymerization of polymer latexes. The particle size diameter ($\chi_{50}$) of the polymer latexes can be from about 1 nm to about 10 am, alternatively from about 10 nm to about 1 am, or even from about 10 nm to about 20 nm.

Fatty Acid

The fabric enhancer composition may comprise fabric softener active comprising fatty acid, such as a free fatty acid (comprising $C_{16}$ to $C_{22}$ saturated and unsaturated, for example behenic acid). The term "fatty acid" is used herein in the broadest sense to include unprotonated or protonated forms of a fatty acid; and includes fatty acid that is bound or unbound to another chemical moiety as well as the various combinations of these species of fatty acid. In one embodiment, the fabric enhancer composition comprises from 0.1% to 5%, preferably from 0.2% to 4%, more preferably from 0.3% to 3% by weight of additional fabric softener active comprising fatty acid. One skilled in the art will readily appreciate that the pH of an aqueous composition will dictate, in part, whether a fatty acid is protonated or unprotonated. In another embodiment, the fatty acid is in its unprotonated, or salt form, together with a counter ion, such as, but not limited to, calcium, magnesium, sodium, potassium and the like. The term "free fatty acid" means a fatty acid that is not bound to another chemical moiety (covalently or otherwise) to another chemical moiety.

The fatty acid may include those containing from about 12 to about 25, from about 13 to about 22, or even from about 16 to about 20, total carbon atoms, with the fatty moiety containing from about 10 to about 22, from about 12 to about 18, or even from about 14 (mid-cut) to about 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc.; (3) processed and/or bodied oils, such as linseed oil or tung oil via thermal, pressure, alkali-isomerization and catalytic treatments; (4) a mixture thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids.

Mixtures of fatty acids from different fat sources can be used.

At least a majority of the fatty acid that is present in the fabric softening composition of the present invention may be unsaturated, e.g., from about 40% to 100%, from about 55% to about 99%, or even from about 60% to about 98%, by weight of the total weight of the fatty acid present in the composition, although fully saturated and partially saturated fatty acids can be used. As such, the total level of polyunsaturated fatty acids (TPU) of the total fatty acid of the inventive composition may be from about 0% to about 75% by weight of the total weight of the fatty acid present in the composition.

The cis/trans ratio for the unsaturated fatty acids may be important, with the cis/trans ratio (of the C18:1 material) being from at least about 1:1, at least about 3:1, from about 4:1 or even from about 9:1 or higher.

Branched fatty acids such as isostearic acid are also suitable since they may be more stable with respect to oxidation and the resulting degradation of color and odor quality.

The Iodine Value or "IV" measures the degree of unsaturation in the fatty acid. The fatty acid may have an IV from about 10 to about 140, from about 15 to about 100 or even from about 15 to about 60.

Softening Oil

The fabric enhancer composition may comprise fabric softener active comprising softening oil.

Softening oils include, but are not limited to, vegetable oils (such as soybean, sunflower, coconut-oil and canola), hydrocarbon based oils (natural and synthetic petroleum lubricants, in one aspect polyolefins, isoparaffins, and cyclic paraffins), triolein, caprylic/capric acid triglyceride, fatty esters (such as glycerol monostearate and glycerol distearate), fatty alcohols (such as palmityl and stearyl alcohol), fatty amines, fatty amides, and fatty ester amines. In one embodiment, the fabric enhancer composition comprises from 0.1% to 5%, preferably from 0.2% to 4%, more preferably from 0.3 to 3% by weight of additional fabric softener active comprising softening oils.

Clays

The fabric enhancer composition may comprise fabric softener active comprising clay.

The fabric care composition may comprise a clay as a fabric care active. In one embodiment clay can be a softener or co-softeners with another softening active, for example, silicone. Suitable clays include those materials classified geologically as smectites.

Silicones

The fabric enhancer composition may comprise fabric softener active comprising silicone.

Suitable levels of silicone may comprise from about 0.1% to about 70%, alternatively from about 0.3% to about 40%, alternatively from about 0.5% to about 30%, alternatively from about 1% to about 20% by weight of the composition. Useful silicones can be any silicone comprising compound. The silicone polymer may be selected from the group consisting of cyclic silicones, polydimethylsiloxanes, aminosilicones, cationic silicones, silicone polyethers, silicone resins, silicone urethanes, and mixtures thereof. In one embodiment, the silicone is a polydialkylsilicone, alternatively a polydimethyl silicone (polydimethyl siloxane or "PDMS"), or a derivative thereof. In another embodiment, the silicone is chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of —$(CH_2)_s$— wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

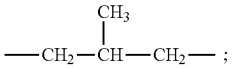

each Z is selected independently from the group consisting of

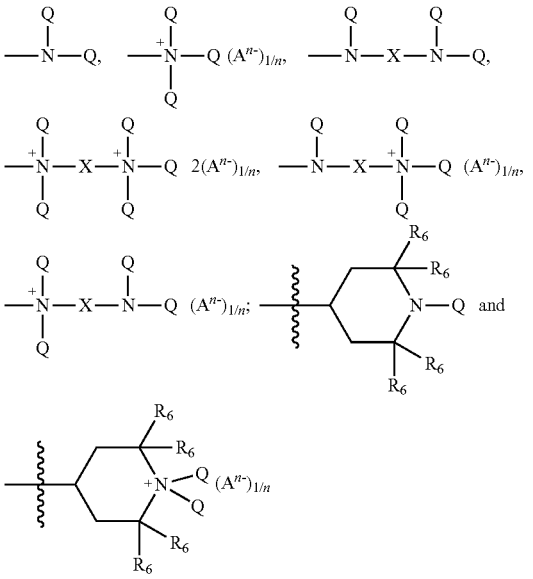

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect, $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

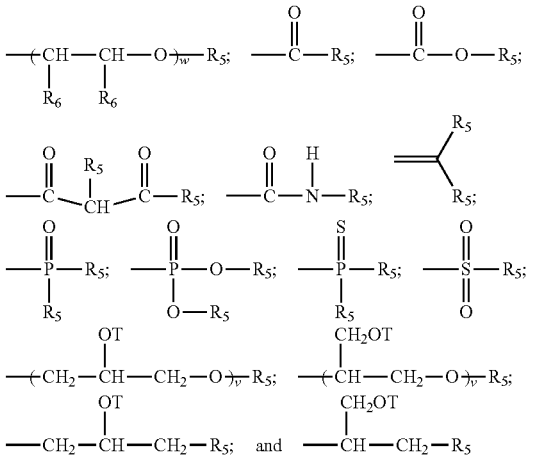

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

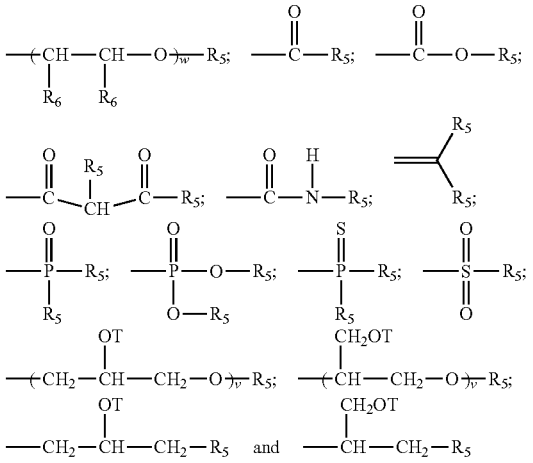

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6$—$CHR_6$—O—$)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

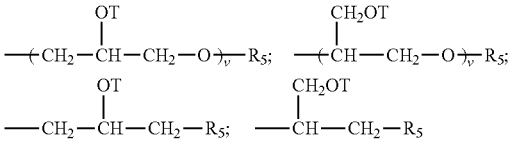

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$=—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—;

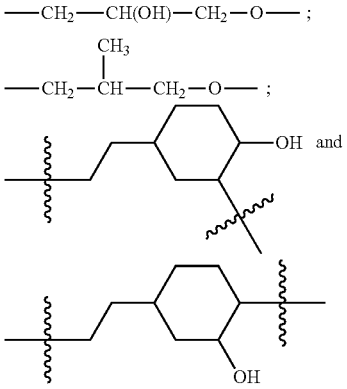

wherein each s independently is an integer from about 2 to about 8, in one aspect s is an integer from about 2 to about 4;

At least one Z in the said organosiloxane is selected from the group consisting of $R_5$;

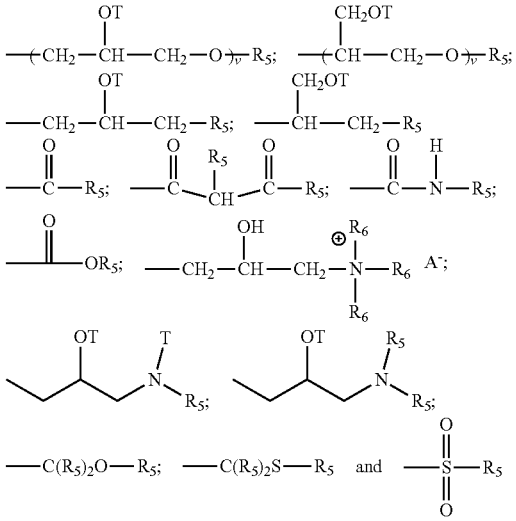

provided that when X is

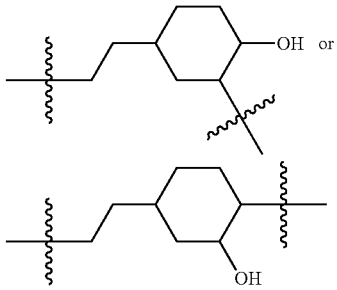

then Z=—$OR_5$ or

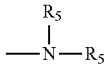

wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

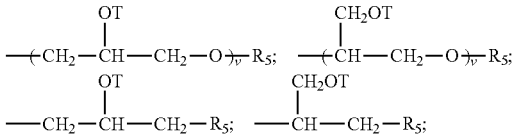

-continued

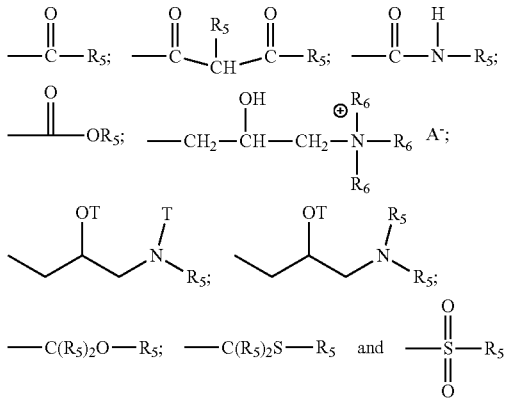

provided that when X is

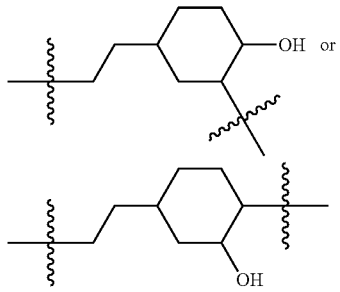

then Z=—$OR_5$ or

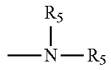

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, —$(CHR_6—CHR_6—O—)_w$—$CHR_6$—$CHR_6$-L and siloxyl residue wherein each L is independently selected from —O—C(O)—$R_7$ or —O—$R_7$; N—$R_7$;

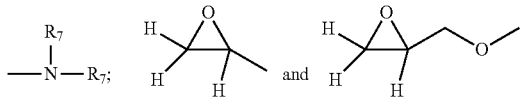

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue;

each T is independently selected from H;

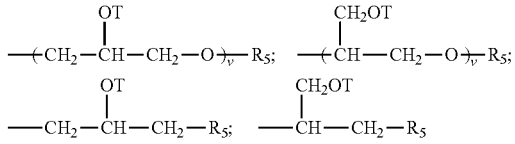

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

In one embodiment, the silicone is one comprising a relatively high molecular weight. A suitable way to describe the molecular weight of a silicone includes describing its viscosity. A high molecular weight silicone is one having a viscosity of from about 10 cSt to about 3,000,000 cSt, or from about 100 cSt to about 1,000,000 cSt, or from about 1,000 cSt to about 600,000 cSt, or even from about 6,000 cSt to about 300,000 cSt.

In one embodiment, the silicone comprises a blocky cationic organopolysiloxane having the formula:

$$M_wD_xT_yQ_z$$

wherein:

M=$[SiR_1R_2R_3O_{1/2}]$, $[SiR_1R_2G_1O_{1/2}]$, $[SiR_1G_1G_2O_{1/2}]$, $[SiG_1G_2G_3O_{1/2}]$, or combinations thereof;

D=$[SiR_1R_2O_{2/2}]$, $[SiR_1G_1O_{2/2}]$, $[SiG_1G_2O_{2/2}]$ or combinations thereof;

T=$[SiR_1O_{3/2}]$, $[SiG_1O_{3/2}]$ or combinations thereof;

Q=$[SiO_{4/2}]$;

w=is an integer from 1 to (2+y+2z);

x=is an integer from 5 to 15,000;

y=is an integer from 0 to 98;

z=is an integer from 0 to 98;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy, $C_1$-$C_{32}$ alkylamino, and $C_1$-$C_{32}$ substituted alkylamino;

at least one of M, D, or T incorporates at least one moiety $G_1$, $G_2$ or $G_3$; and $G_1$, $G_2$, and $G_3$ are each independently selected from the formula:

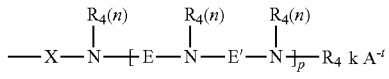

wherein:

X comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide, and ring-opened glycidyl, with the proviso that if X does not comprise a repeating alkylene oxide moiety then X can further comprise a heteroatom selected from the group consisting of P, N and O;

each $R_4$ comprises identical or different monovalent radicals selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

E comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E does not comprise a repeating alkylene oxide moiety then E can further comprise a heteroatom selected from the group consisting of P, N, and O;

E' comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E' does not comprise a repeating alkylene oxide moiety then E' can further comprise a heteroatom selected from the group consisting of P, N, and O;

p is an integer independently selected from 1 to 50;

n is an integer independently selected from 1 or 2;

when at least one of $G_1$, $G_2$, or $G_3$ is positively charged, $A^{-t}$ is a suitable charge balancing anion or anions such that the total charge, k, of the charge-balancing anion or anions is equal to and opposite from the net charge on the moiety $G_1$, $G_2$ or $G_3$; wherein t is an integer independently selected from 1, 2, or 3; and $k \leq (p*2/t)+1$; such that the total number of cationic charges balances the total number of anionic charges in the organopolysiloxane molecule;

and wherein at least one E does not comprise an ethylene moiety.

Surfactants—

The compositions according to the present invention may comprise on top of the nonionic surfactant of Formula A or B, a surfactant or surfactant system wherein the surfactant can be selected from nonionic surfactants, anionic surfactants, cationic surfactants, ampholytic surfactants, zwitterionic surfactants, semi-polar nonionic surfactants and mixtures thereof.

The surfactant is typically present at a level of from about 0.1% to about 60%, from about 1% to about 50% or even from about 5% to about 40% by weight of the subject composition.

Fabric Hueing Agents—The composition may comprise a fabric hueing agent (sometimes referred to as shading, bluing or whitening agents). Typically, the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof. Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Acid, Direct, Basic, Reactive (or hydrolysed forms thereof), Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes as disclosed in U.S. Pat. No. 8,268,016 B2, or dyes as disclosed in U.S. Pat. No. 7,208,459 B2, or dyes disclosed in U.S. Pat. No. 8,247,364 B2 and mixtures thereof. In another aspect, suitable small molecule dyes include small molecule dyes selected from the group consisting of C. I. numbers Acid Violet 17, Acid Blue 80, Acid Violet 50, Direct Blue 71, Direct Violet 51, Direct Blue 1, Acid Red 88, Acid Red 150, Acid Blue 29, Acid Blue 113, fabric hueing agents that undergo a transition on storage or during or after use that either (1) changes the extinction coefficient in the visible range at a set wavelength (400-750 nm) from less than 1000 $M^{-1}$ $cm^{-1}$ to one greater than 5,000, preferably greater than 10,000, more preferably greater than 20,000, even more preferably greater than 50,000, most preferably greater than 80,000 or even 100,000 $M^{-1}cm^{-1}$, (2) increases the extinction coefficient in the visible range at a set wavelength (400-750 nm) by a factor of at least five, preferably ten or even twenty fold wherein the final extinction coefficient at the set wavelength is at least 10,000 $M^{-1}cm^{-1}$, or (3) shifts the wavelength of the maximum extinction coefficient within the visible range from the pre-transition value by at least 25 nm, preferably 50 nm, even more preferably 75 nm, most preferably by 100 nm or more, wherein the final wavelength of the maximum extinction coefficient within the visible range is from about 550 to 700 nm, preferably from 550 to 650 nm, and/or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in U.S. Pat. No. 7,686,892 B2.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Suitable dye clay conjugates include dye clay conjugates selected from the group comprising at least one cationic/ basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

The hueing agent may be incorporated into the detergent composition as part of a reaction mixture which is the result of the organic synthesis for a dye molecule, with optional purification step(s). Such reaction mixtures generally comprise the dye molecule itself and in addition may comprise un-reacted starting materials and/or by-products of the organic synthesis route.

Suitable polymeric bluing agents may be alkoxylated. As with all such alkoxylated compounds, the organic synthesis may produce a mixture of molecules having different degrees of alkoxylation. Such mixtures may be used directly to provide the hueing agent, or may undergo a purification step to increase the proportion of the target molecule.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by $C_1$-$C_3$-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof. In another aspect, suitable pigments include pigments selected from the group consisting of Ultramarine Blue (C.I. Pigment Blue 29), Ultramarine Violet (C.I. Pigment Violet 15), Monastral Blue and mixtures thereof.

The aforementioned fabric hueing agents can be used in combination (any mixture of fabric hueing agents can be used).

Chelating Agents—

The composition may contain a chelating agent. Suitable chelating agents include copper, iron and/or manganese chelating agents and mixtures thereof. When a chelating agent is used, the composition may comprise from about 0.1% to about 15% or even from about 3.0% to about 10% chelating agent by weight of the subject composition.

Dye Transfer Inhibiting Agents—

The composition may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

When present in a subject composition, the dye transfer inhibiting agents may be present at levels from about 0.0001% to about 10%, from about 0.01% to about 5% or even from about 0.1% to about 3% by weight of the composition.

Dispersants—

The composition can also contain dispersants. Suitable water-soluble organic materials include the homo- or copolymeric acids or their salts, in which the polycarboxylic acid comprises at least two carboxyl radicals separated from each other by not more than two carbon atoms.

Perfumes—

The perfume composition may comprise from 2.5% to 30%, preferably from 5% to 30% of perfume raw materials characterized by a C log P lower than 3.0, and a boiling point lower than 250° C., from 5% to 30%, preferably from 7% to 25% of perfume raw material characterized by a C log P lower than 3.0 and a boiling point higher than 250° C., from 35% to 60%, preferably from 40% to 55% of perfume raw materials characterized by a C log P higher than 3.0 and a boiling point lower than 250° C., from 10% to 45%, preferably from 12% to 40% of perfume raw materials characterized by C log P higher than 3.0 and a boiling point higher than 250° C.

The "calculated log P" (C log P) is determined by the fragment approach of Hansch and Leo (cf., A. Leo, in Comprehensive Medicinal Chemistry, Vol. 4, C. Hansch, P. G. Sammens, J. B. taylor, and C. A. Ramsden, Eds. P. 295, Pergamon Press, 1990).

Perfume Delivery Technologies

The fabric enhancer compositions may comprise one or more perfume delivery technologies that stabilize and enhance the deposition and release of perfume ingredients from treated substrate. Such perfume delivery technologies can also be used to increase the longevity of perfume release from the treated substrate. Perfume delivery technologies, methods of making certain perfume delivery technologies and the uses of such perfume delivery technologies are disclosed in US 2007/0275866 A1.

In one aspect, the fabric enhancer composition may comprise from about 0.001% to about 20%, or from about 0.01% to about 10%, or from about 0.05% to about 5%, or even from about 0.1% to about 0.5% by weight of the perfume delivery technology. In one aspect, said perfume delivery technologies may be selected from the group consisting of: benefit agent delivery particle, pro-perfumes, polymer particles, functionalized silicones, polymer assisted delivery, molecule assisted delivery, fiber assisted delivery, amine assisted delivery, cyclodextrins, starch encapsulated accord, zeolite and inorganic carrier, and mixtures thereof:

In one aspect, said perfume delivery technology may comprise microcapsules formed by at least partially surrounding a benefit agent with a wall material. Said benefit agent may include materials selected from the group consisting of perfumes; silicone oils, waxes such as polyethylene waxes; essential oils such as fish oils, jasmine, camphor, lavender; skin coolants such as menthol, methyl lactate; vitamins such as Vitamin A and E; sunscreens; glycerine; catalysts such as manganese catalysts or bleach catalysts; bleach particles such as perborates; silicon dioxide particles; antiperspirant actives; cationic polymers and mixtures thereof. Suitable benefit agents can be obtained from Givaudan Corp. of Mount Olive, N.J., USA, International Flavors & Fragrances Corp. of South Brunswick, N.J., USA, or Quest Corp. of Naarden, Netherlands.

In one aspect, the perfume may comprise from 2.5% to 30%, preferably from 5% to 30% of perfume raw materials characterized by a C log P lower than 3.0, and a boiling point lower than 250° C., from 5% to 30%, preferably from 7% to 25% of perfume raw material characterized by a C log P lower than 3.0 and a boiling point higher than 250° C., from 35% to 60%, preferably from 40% to 55% of perfume raw materials characterized by a C log P higher than 3.0 and a boiling point lower than 250° C., from 10% to 45%, preferably from 12% to 40% of perfume raw materials characterized by C log P higher than 3.0 and a boiling point higher than 250° C.

The "calculated log P" (C log P) is determined by the fragment approach of Hansch and Leo (cf., A. Leo, in Comprehensive Medicinal Chemistry, Vol. 4, C. Hansch, P. G. Sammens, J. B. taylor, and C. A. Ramsden, Eds. P. 295, Pergamon Press, 1990, incorporated herein by reference). C log P values may be calculated by using the "C LOG P" program available from Daylight Chemical Information Systems Inc. of Irvine, Calif. U.S.A.

In one aspect, the microcapsule wall material may comprise: melamine, polyacrylamide, silicones, silica, polystyrene, polyurea, polyurethanes, polyacrylate based materials, polymethacrylate based materials, polyacrylate esters based materials, gelatin, styrene malic anhydride, polyamides, and mixtures thereof. In one aspect, said melamine wall material may comprise melamine crosslinked with formaldehyde, melamine-dimethoxyethanol crosslinked with formaldehyde, and mixtures thereof. In one aspect, said polystyrene wall material may comprise polyestyrene cross-linked with divinylbenzene. In one aspect, said polyurea wall material may comprise isocyanate based monomers and amine-containing crosslinkers such as guanidine carbonate or guanazole. Preferred polyurea microcapsules comprise a polyurea wall which is the reaction product of the polymerisation between at least one polyisocyanate comprising at least two isocyanate functional groups and at least one reactant selected from the group consisting of a water soluble guanidine salt and guanidine; a colloidal stabilizer; and an encapsulated perfume. In one aspect, said polyacrylate based materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof. In one aspect, the perfume microcapsule may be coated with a deposition aid, a cationic polymer, a nonionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, chitosans, and combinations thereof. Suitable deposition aids are described above and in the section titled "Deposition Aid". In one aspect, the microcapsule may be a perfume microcapsule. In one aspect, one or more types of microcapsules, for example two microcapsules types having different perfume benefit agents may be used.

In one aspect, said perfume delivery technology may comprise an amine reaction product (ARP) or a thio reaction product. One may also use "reactive" polymeric amines and or polymeric thios in which the amine and/or thio functionality is pre-reacted with one or more PRMs to form a reaction product. Typically, the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxyl amines, such as 2-aminoethanol and its alkyl substituted derivatives, and aromatic amines such as anthranilates. The ARPs may be premixed with perfume or added separately in leave-on or rinse-off applications. In another aspect, a material that contains a heteroatom other than nitrogen and/or sulfur, for example oxygen, phosphorus or selenium, may be used as an alternative to amine compounds. In yet another aspect, the aforementioned alternative compounds can be used in combination with amine compounds. In yet another aspect, a single molecule may comprise an amine moiety and one or more of the alternative heteroatom moieties, for example, thiols, phosphines and selenols. The benefit may include improved delivery of perfume as well as controlled perfume release. Suitable ARPs as well as methods of making same can be found in USPA 2005/0003980 A1 and U.S. Pat. No. 6,413,920 B1.

Processes of Making the Fabric Enhancer Composition of the Invention

The compositions of the present invention can be formulated into any suitable form and prepared by any process chosen by the formulator, non-limiting examples of which are described in Applicant's examples and in US 2013/0109612 A1 which is incorporated herein by reference.

In one aspect, the compositions disclosed herein may be prepared by combining the components thereof in any convenient order and by mixing, e.g., agitating, the resulting component combination to form a phase stable fabric and/or home care composition. In one aspect, a fluid matrix may be formed containing at least a major proportion, or even substantially all, of the fluid components with the fluid components being thoroughly admixed by imparting shear agitation to this liquid combination. For example, rapid stirring with a mechanical stirrer may be employed. In one aspect, the liquid fabric enhancer compositions described herein can be made as follows:

Taking an apparatus A comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear and/or turbulence in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear and/or turbulence in the liquid, the inlet 1A, pre-mixing chamber 2, the orifice component 5 and secondary mixing chamber 8 are linear and in straight line with each other, at least one outlet 9 being located at the downstream end of the secondary mixing chamber 8; the orifice component 5 comprising at least one orifice unit, a specific example is that the orifice component 5 comprises two orifice units 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighboring orifice plates are distinct from each other;

connecting one or more suitable liquid pumping devices to the first inlet 1A and to the second inlet 1B;

pumping a second liquid composition into the first inlet 1A, and, pumping a liquid fabric enhancing active composition into the second inlet 1B, wherein the operating pressure of the apparatus is from about 2.5 bar to about 50 bar, from about 3 bar to about 20 or from about 3.5 bar to about 10 bar the operating pressure being the pressure of the liquid as measured in the first inlet 1A near to inlet 1B. The operating pressure at the outlet of apparatus A needs to be high enough to prevent cavitation in the orifice;

allowing the liquid fabric enhancing active and the second liquid composition to pass through the apparatus A at a desired flow rate, wherein as they pass through the apparatus A, they are dispersed one into the other, herein, defined as a liquid fabric enhancer intermediate.

passing said liquid fabric enhancer intermediate from Apparatus A's outlet, to Apparatus B's inlet 16 to subject the liquid fabric enhancer intermediate to additional shear and/or turbulence for a period of time within Apparatus B.

circulating said liquid fabric enhancer intermediate within apparatus B with a circulation Loop pump 17 at a Circulation Loop 18 Flow Rate equal to or greater than said inlet liquid fabric enhancer intermediate flow rate in said Circulation Loop System. A tank, with or without a recirculation loop, or a long conduit may also be employed to deliver the desired shear and/or turbulence for the desired time.

adding by means of a pump 19, piping and in-line fluid injector 20, an adjunct fluid, in one aspect, but not limited to a dilute salt solution, into Apparatus B to mix with the liquid fabric enhancer intermediate allowing the liquid fabric enhancer composition with the desired microstructure to exit Apparatus B 21 at a rate equal to the inlet flow rate into Apparatus B.

passing said liquid fabric enhancer composition exiting Apparatus B outlet through a heat exchanger to be cooled to ambient temperature, if necessary.

discharging the resultant liquid fabric enhancing composition produced out of the outlet of the process.

The process comprises introducing, in the form of separate streams, the fabric enhancing active in a liquid form and a second liquid composition comprising other components of a fabric enhancing composition into the pre-mixing chamber 2 of Apparatus A so that the liquids pass through the orifice component 5. The fabric enhancer active in a liquid form and the second liquid composition pass through the orifice component 5 under pressure. The fabric enhancer active in liquid form and the second liquid composition can be at the same or different operating pressures. The orifice component 5 is configured, either alone, or in combination with some other component, to mix the liquid fabric enhancer active and the second liquid composition and/or produce shear and/or turbulence in each liquid, or the mixture of the liquids.

The liquids can be supplied to the apparatus A and B in any suitable manner including, but not limited to through the use of pumps and motors powering the same. The pumps can supply the liquids to the apparatus A under the desired operating pressure. In one embodiment, an '8 frame block-style manifold' is used with a 781 type Plunger pump available from CAT pumps (1681 94th Lane NE, Minneapolis, Minn. 55449).

The operating pressure of conventional shear and/or turbulence apparatuses is typically between about 2 bar and 490 bar. The operating pressure is the pressure of the liquid in the inlet 1A near inlet 1B. The operating pressure is provided by the pumps.

The operating pressure of Apparatus A is measured using a Cerphant T PTP35 pressure switch with a RVS membrane, manufactured by Endress Hauser (Endress+Hauser Instruments, International AG, Kaegenstrasse 2, CH-4153, Reinach). The switch is connected with the inlet 1A near inlet 1B using a conventional thread connection (male thread in the pre-mix chamber housing, female thread on the Cerphant T PTP35 pressure switch).

The operating pressure of Apparatus A may be lower than conventional shear and/or turbulence processes, yet the same degree of liquid mixing is achievable as seen with processes using conventional apparatuses. Also, at the same operating pressures, the process of the present invention results in better mixing than is seen with conventional shear and/or turbulence processes.

As the fabric enhancing active and the second liquid composition flow through the Apparatus A, they pass through the orifices 13 and 21 of the orifice component 5. As they do, they exit the orifice 13 and/or 21 in the form of a jet. This jet produces shear and/or turbulence in the fabric enhancing active and the second liquid composition, thus dispersing them one in the other to form a uniform mixture.

In conventional shear and/or turbulence processes, the fact that the liquids are forced through the orifice 13 and/or 15 under high pressure causes them to mix. This same degree of mixing is achievable at lower pressures when the liquids are forced through a series of orifices, rather than one at a high pressure. Also, at equivalent pressures, the process of the present invention results in better liquid mixing than shear and/or turbulence processes, due to the fact that the liquids are now forced through a series of orifices.

A given volume of liquid can have any suitable residence time and/or residence time distribution within the apparatus A. Some suitable residence times include, but are not limited to from about 1 microsecond to about 1 second, or more. The liquid(s) can flow at any suitable flow rate through the apparatus A. Suitable flow rates range from about 1 to about 1,500 L/minute, or more, or any narrower range of flow rates falling within such range including, but not limited to from about 5 to about 1,000 L/min.

For Apparatus B Circulating Loop System example, one may find it convenient to characterize the circulation flow by a Circulation Loop Flow Rate Ratio which is equal to the Circulation Flow Rate divided by the Inlet Flow Rate. Said Circulation Loop Flow Rate Ratio for producing the desired fabric enhancer composition microstructure can be from about 1 to about 100, from about 1 to about 50, and even from about 1 to about 20. The fluid flow in the circulation loop imparts shear and turbulence to the liquid fabric enhancer to transform the liquid fabric enhancer intermediate into a desired dispersion microstructure.

The duration of time said liquid fabric enhancer intermediate spends in said Apparatus B may be quantified by a Residence Time equal to the total volume of said Circulation Loop System divided by said fabric enhancer intermediate inlet flow rate. Said Circulation Loop Residence Time for producing desirable liquid fabric enhancer composition microstructures may be from about 0.1 seconds to about 10 minutes, from about 1 second to about 1 minute, or from about 2 seconds to about 30 seconds. It is desirable to minimize the residence time distribution.

Shear and/or turbulence imparted to said liquid fabric enhancer intermediate may be quantified by estimating the total kinetic energy per unit fluid volume. The kinetic energy per unit volume imparted in the Circulation Loop System to the fabric enhancer intermediate in Apparatus B may be from about 10 to 1,000,000 g/cm $s^2$, from about 50 to 500,000 g/cm $s^2$, or from about 100 to about 100,000 g/cm $s^2$. The liquid(s) flowing through Apparatus B can flow at any suitable flow rate. Suitable inlet and outlet flow rates range from about 1 to about 1,500 L/minute, or more, or any narrower range of flow rates falling within such range including, but not limited to from about 5 to about 1,000 L/min. Suitable Circulation Flow Rates range from about 1 l/min to 20,000 l/min or more, or any narrower range of flow rates falling within such range including but not limited to from about 5 to about 10,000 l/min. Apparatus A is ideally operated at the same time as Apparatus B to create a continuous process. The liquid fabric enhancer intermediate created in Apparatus A may also be stored in a suitable vessel and processed through apparatus B at a later time.

In non-limiting examples A through N below, fabric enhancing composition products were produced using apparatus A and B in a continuous fluid making process. Heated fabric enhancer active and heated deionized water containing adjunct materials were fed using positive displacement pumps, through Apparatus A, through apparatus B, a circulation loop fitted with a centrifugal pump. The fluid fabric enhancer composition was immediately cooled with a plate heat exchanger. Fabric enhancer active, deionized water containing adjunct materials were continuously fed to the continuous fluid making process using pumps in which motor speed was controlled continuously from flow meter feedback. Flow rates, pressures and temperatures of each inlet stream were monitored during processing to insure quality.

TABLE 1

Exemplary process conditions A through N that may be used to make the fabric enhancers of the present invention.

| | A | B | C | D | E | F | G |
|---|---|---|---|---|---|---|---|
| Number of orifices | 1 | 3 | 3 | 1 | 3 | 3 | 3 |
| Water Seat temperature [° C.] | 65 | 48 | 65 | 65 | 65 | 38 | 65 |
| Fabric Enhancing Active Temperature [° C.] | 81 | 80 | 81 | 81 | 81 | 60 | 81 |
| Total Flow Rate [kg/min] | 3.1 | 3.1 | 3.1 | 3.1 | 3.1 | 10 | 2.4 |
| Pressure at Apparatus A Inlet [bar] | 4 | 4.7 | 5 | 4.1 | 6 | 6.5 | 4.2 |
| Pressure at Apparatus A Outlet [bar] | 3.1 | 2.7 | 3 | 3.2 | 4 | 3.5 | 2.7 |
| Apparatus B Circulation Loop Flow rate Ratio | 8.4 | 8.4 | 8.4 | 8.4 | 8.4 | 1 | 8.4 |
| Apparatus B Kinetic Energy [g/cm/$sec^2$] | 18000 | 18000 | 18000 | 18000 | 18000 | 550 | 10500 |
| Apparatus B Residence Time [sec] | 14 | 14 | 14 | 14 | 14 | 13 | 17 |
| Apparatus B Outlet pressure [bar] | 1.1 | 1.5 | 2 | 1.7 | 3 | 1.5 | 2 |
| Fabric Enhancing Composition Temperature Exiting Heat Exchanger [° C.] | 25 | 25 | 25 | 25 | 25 | 22 | 25 |

TABLE 1-continued

Exemplary process conditions A through N that may be used to make the fabric enhancers of the present invention.

| | H | I | J | K | L | M | N |
|---|---|---|---|---|---|---|---|
| Number of orifices | 1 | 3 | 3 | 1 | 3 | 3 | 2 |
| Water Seat temperature [° C.] | 65 | 48 | 65 | 65 | 65 | 38 | 75 |
| Fabric Enhancing Active Temperature [° C.] | 81 | 80 | 81 | 81 | 81 | 60 | 80 |
| total flow rate [kg/min] | 250 | 750 | 750 | 750 | 250 | 750 | 250 |
| Pressure at Apparatus A Inlet [bar] | 4 | 4.7 | 5 | 4.1 | 6 | 6.5 | 8 |
| Pressure at Apparatus A Outlet [bar] | 3.1 | 2.7 | 3 | 3.2 | 4 | 3.5 | 3 |
| Apparatus B Circulation Loop Flow rate Ratio | 8 | 1 | 4 | 8 | 8 | 1 | 5 |
| Apparatus B Kinetic Energy [g/cm/$s^2$] | 36000 | 600 | 9500 | 38000 | 40000 | 600 | 14500 |
| Apparatus B Residence Time [s] | 14 | 14 | 14 | 14 | 14 | 14 | 14 |
| Apparatus B Outlet pressure [bar] | 1.1 | 1.5 | 2 | 1.7 | 3 | 1.5 | 2 |
| Fabric Enhancing Composition Temperature Exiting Heat Exchanger [° C.] | 25 | 24 | 20 | 22 | 20 | 22 | 27 |

The process may be used to make many different kinds of fabric enhancing composition products including, but not limited to liquids, emulsions, dispersions, gels and blends.

In one embodiment, the resultant fabric enhancing composition is liquid at room temperature. In another embodiment, the resultant fabric enhancing composition is highly concentrated. By highly concentrated we herein mean the fabric enhancing active is present between 50% and 90% by weight of the fabric enhancing composition. In yet another embodiment, the resultant fabric enhancing composition is highly concentrated and is liquid at ambient temperature. The term liquid can encompass non-viscous liquids, viscous liquids, emulsions, dispersions, a gels or blends. The resultant fabric enhancing composition can encompass structured liquids, where the structuring is provided by the particles residing in the dispersion. These particles can be of any shape and size.

Furthermore, additional ingredients may be added to the above fabric enhancing compositions using a one or more incorporation processes. The additional ingredients may be added as a component of inlet streams into Apparatus A and/or B. These ingredients may be added to the fabric enhancing composition between processes A and B. These ingredients may be added to the fabric enhancing composition following processes A and B. In all processes, these ingredients may be added to the fabric enhancing composition in a batch mixing container or injected into a continuously flowing stream contained within a pipe or mixing device.

Those skilled the art will recognize what concentrations of components to add to achieve the resultant desired composition.

Method of Use

The compositions of the present invention may be used in any conventional manner. In short, they may be used in the same manner as products that are designed and produced by conventional methods and processes. For example, compositions of the present invention can be used to treat a situs inter alia a surface or fabric. Typically, at least a portion of the situs is contacted with an aspect of Applicants' composition, in neat form or diluted in a wash liquor, and then the situs is optionally washed and/or rinsed. For purposes of the present invention, washing includes but is not limited to, scrubbing, and mechanical agitation. The fabric may comprise any fabric capable of being laundered in normal consumer use conditions. When the wash solvent is water, the water temperature typically ranges from about 5° C. to about 90° C. and, when the situs comprises a fabric, the water to fabric mass ratio is typically from about 1:1 to about 100:1.

The consumer products of the present invention may be used as liquid fabric enhancers wherein they are applied to a fabric and the fabric is then dried via line drying and/or drying the an automatic dryer.

METHODS

Method of Determining pH

The pH is measured on the neat composition, at about 20-21° C., using a Sartarius PT-10P pH meter with gel-filled probe (such as the Toledo probe, part number 52 000 100), calibrated according to the instructions manual.

Method of Determining Viscosity

The viscosity of neat product is determined using a Brookfield® DV-E rotational viscometer, spindle 2, at 60 rpm, at about 20-21° C.

Method of Measuring Iodine Value (IV) of a Quaternary Ammonium Ester Fabric Softening Active:

The iodine value of a quaternary ammonium ester fabric softening active is the iodine value of the parent fatty acyl compound or acid from which the fabric softening active is formed, and is defined as the number of grams of iodine which react with 100 grams of parent fatty acyl compound or acid from which the fabric softening active is formed.

First, the quaternary ammonium ester fabric softening active is hydrolysed according to the following protocol: 25 g of fabric enhancer composition is mixed with 50 mL of water and 0.3 mL of sodium hydroxide (50% activity). This mixture is boiled for at least an hour on a hotplate while avoiding that the mixture damps dry. After an hour, the mixture is allowed to cool down and the pH is adjusted to neutral (pH between 6 and 8) with sulfuric acid 25% using pH strips or a calibrated pH electrode.

Next the fatty acyl compound or acid is extracted from the mixture via acidified liquid-liquid extraction with hexane or petroleum ether: The sample mixture is diluted with water/ethanol (1:1) to 160 mL in an extraction cylinder, about 5 grams of sodium chloride, 0.3 mL of sulfuric acid (25% activity) and 50 mL of hexane are added. The cylinder is stoppered and shaken for at least 1 minute. Next, the cylinder is left to rest until 2 layers are formed. The top layer containing the fatty acyl compound or acid in hexane is transferred to another recipient. The hexane is then evaporated using a hotplate leaving behind the extracted fatty acyl compound or acid.

Next, the iodine value of the parent fatty acyl compound or acid from which the fabric softening active is formed is determined following ISO3961. The method for calculating the iodine value of a parent fatty acyl compound/acid comprises dissolving a prescribed amount (from 0.1-3 g) into 15 ml of chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After the addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated.

Freeze-Thaw Cycle:

The viscosity of the Fabric enhancer compositions is measured 24 hrs after making and after a freeze-thaw (F/T) cycle to assess their robustness under extreme cold temperatures. The freeze-thaw cycle procedure consists of filling a 200 mL glass jar with 150 mL of the Fabric enhancer composition, closing the jar with a metal lid, putting the filled glass jar in a freezer at −18° C. for 4 consecutive days. After 4 days, the sample is taken out of the freezer and left to recover by exposing it at a temperature of 20-21° C. After 3 consecutive days at 20-21° C., the viscosity is measured again. This viscosity is referred to as the viscosity after a F/T cycle.

EXAMPLES

Examples 1-24: Fabric Enhancer Compositions

The fabric enhancer compositions of Examples 1-24 are prepared by first preparing dispersions of the quaternary ammonium ester softener active using process parameters from Table 1. Adjunct materials NaHEDP, HCl, Formic Acid, and the preservative are added to the water seat. If present, coconut oil and isopropanol are added to the hot fabric enhancing active at 80-81° C. prior to mixing with the water seat. $CaCl_2$ is added as an aqueous dilution through the in-line fluid injector of Apparatus B.

The fabric enhancer compositions are finished by adding the remaining ingredients provided in Table 2 below to the dispersions described in the paragraph above using a Ytron-Y high speed mixer operated at 20 Hz for 15-20 minutes. Table 2 shows the overall composition of Examples 1-24. With the exception of the nonionic surfactant level, the ingredients are added as received. For example, in Example 1 below the preservative is added at an actual, as received from the supplier level of 0.020% while the active ingredient 1,2-benzisothiazolin-3-one is present in the preservative solution at a level of 20%. The nonionic surfactant level refers to the actual level of nonionic surfactant based on 100% activity. For example, in Example 23 below, the level in the fabric enhancer composition of Genapol X407 as received from the supplier is 1.7% as Genapol X407 is only 70% active, Example 23 actually contains on an active level, 1.2% nonionic surfactant. Examples 5, 6, 12, 13, 14, 15, 16, 17, 23, and 24 illustrate the invention. The remaining examples are comparative examples indicated with an asterisk.

TABLE 2

Fabric enhancer composition Examples 1 through 24. The examples marked with an asterisk are comparative examples.

| | (Weight percent) | | | | | | |
|---|---|---|---|---|---|---|---|
| | Ex 1* | Ex 2* | Ex 3* | Ex 4* | Ex 5 | Ex 6 | Ex 7* |
| Dispersion created using the process parameters from Table 1 | B | D | D | D | A | A | A |
| DI water | balance | balance | balance | balance | balance | balance | balance |
| NaHEDP | 0.0064 | 0.0064 | 0.0065 | 0.0064 | 0.0064 | 0.0064 | 0.0064 |
| Formic acid | 0.041 | 0.041 | 0.041 | 0.040 | 0.040 | 0.040 | 0.041 |
| HCI | 0.0081 | 0.0181 | 0.0183 | 0.0180 | 0.0180 | 0.0180 | 0.0181 |
| Preservative[a] | 0.020 | 0.020 | 0.004 | 0.020 | 0.020 | 0.020 | 0.020 |
| FSA1[b] | 7.0 | 0.0 | 0.0 | 0.0 | 0.0 | 0.0 | 0.0 |
| FSA2[c] | 0.0 | 0.0 | 0.0 | 0.0 | 0.0 | 0.0 | 0.0 |
| FSA3[d] | 0.0 | 0.0 | 0.0 | 0.0 | 7.2 | 7.2 | 7.2 |
| FSA4[e] | 0.0 | 7.2 | 7.3 | 7.2 | 0.0 | 0.0 | 0.0 |
| FSA5[f] | 0.0 | 0.0 | 0.0 | 0.0 | 0.0 | 0.0 | 0.0 |
| Antifoam[g] | 0.092 | 0.092 | 0.007 | 0.091 | 0.091 | 0.091 | 0.092 |
| coconut oil | 0.24 | 0.24 | 0.24 | 0.24 | 0.00 | 0.00 | 0.00 |
| CaCl2 | 0.00 | 0.02 | 0.02 | 0.02 | 0.02 | 0.02 | 0.02 |
| Isopropanol | 0.72 | 0.72 | 0.73 | 0.71 | 0.00 | 0.00 | 0.00 |
| Encapsulated perfume[h] | 0.14 | 0.14 | 0.00 | 0.14 | 0.14 | 0.14 | 0.14 |
| Dye1 | 0.0100 | 0.0100 | 0.0000 | 0.0100 | 0.0100 | 0.0100 | 0.0100 |
| Dye2 | 0.0000 | 0.0000 | 0.0000 | 0.0000 | 0.0000 | 0.0000 | 0.0000 |
| Polymeric thickener[i] | 0.15 | 0.15 | 0.15 | 0.15 | 0.15 | 0.15 | 0.15 |
| Glycerol | 7.6 | 7.6 | 7.6 | 7.6 | 7.6 | 7.6 | 7.6 |
| Nonionic surfactant type | Solvapol N247 | Solvapol N247 | Solvapol N247 | Solvapol N247 | Tergitol 15-S-30 | Tergitol NP-30 | Tergitol 15-S-30 |
| Nonionic surfactant[j] | 0.6 | 0.6 | 0.6 | 1.2 | 1.2 | 1.2 | 0.6 |
| Silicone co-softener[k] | 0.0 | 0.0 | 0.0 | 0.0 | 0.0 | 0.0 | 0.0 |
| Perfume oil | 0.52 | 0.52 | 0.00 | 0.52 | 0.52 | 0.52 | 0.52 |
| Ratio quaternary ammonium FSA/nonionic surfactant | 11.7 | 12.1 | 12.2 | 6.0 | 6.0 | 6.0 | 12.1 |
| Viscosity after 24 hr [cP][l] | 163 | 81 | 18 | 103 | 51 | 46 | 78 |
| Viscosity after F/T cycle [cP][m] | 379 | 1080 | 20 | 830 | 150 | 117 | 2300 |

| | (Weight percent) | | | | | | |
|---|---|---|---|---|---|---|---|
| | Ex 8* | Ex 9* | Ex 10* | Ex 11* | Ex 12 | Ex 13 | Ex 14 |
| Dispersion created using the process parameters from Table 1 | A | A | A | A | B | D | C |
| DI water | Balance | Balance | Balance | Balance | Balance | Balance | Balance |
| NaHEDP | 0.0064 | 0.0064 | 0.0064 | 0.0064 | 0.0064 | 0.0064 | 0.0064 |
| Formic acid | 0.041 | 0.040 | 0.041 | 0.040 | 0.040 | 0.040 | 0.040 |
| HCI | 0.0181 | 0.0180 | 0.0181 | 0.0180 | 0.0081 | 0.0179 | 0.0179 |
| Preservative[a] | 0.020 | 0.020 | 0.020 | 0.020 | 0.020 | 0.020 | 0.020 |
| FSA1[b] | 0.0 | 0.0 | 0.0 | 0.0 | 6.9 | 0.0 | 0.0 |
| FSA2[c] | 0.0 | 0.0 | 0.0 | 0.0 | 0.0 | 0.0 | 6.3 |
| FSA3[d] | 7.2 | 7.2 | 7.2 | 7.2 | 0.0 | 0.0 | 0.0 |
| FSA4[e] | 0.0 | 0.0 | 0.0 | 0.0 | 0.0 | 7.2 | 0.0 |
| FSA5[f] | 0.0 | 0.0 | 0.0 | 0.0 | 0.0 | 0.0 | 0.0 |
| Antifoam[g] | 0.092 | 0.091 | 0.092 | 0.091 | 0.091 | 0.091 | 0.091 |
| coconut oil | 0.00 | 0.00 | 0.00 | 0.00 | 0.24 | 0.24 | 0.00 |
| CaCl2 | 0.02 | 0.02 | 0.02 | 0.02 | 0.00 | 0.02 | 0.01 |

TABLE 2-continued

Fabric enhancer composition Examples 1 through 24. The examples marked with an asterisk are comparative examples.

| | | | | | | | |
|---|---|---|---|---|---|---|---|
| Isopropanol | 0.00 | 0.00 | 0.00 | 0.00 | 0.71 | 0.71 | 0.00 |
| Encapsulated perfume[h] | 0.14 | 0.14 | 0.14 | 0.14 | 0.14 | 0.19 | 0.19 |
| Dye1 | 0.0100 | 0.0100 | 0.0100 | 0.0100 | 0.0100 | 0.0100 | 0.0100 |
| Dye2 | 0.0000 | 0.0000 | 0.0000 | 0.0000 | 0.0000 | 0.0000 | 0.0000 |
| Polymeric thickener[i] | 0.15 | 0.15 | 0.15 | 0.15 | 0.15 | 0.15 | 0.15 |
| Glycerol | 7.6 | 7.6 | 7.6 | 7.6 | 7.6 | 7.6 | 7.6 |
| Nonionic surfactant type | Lorodac 20-24 | Lorodac 20-24 | Emulan HE 50 | Emulan HE 50 | Tergitol 15-S-30 | Tergitol 15-S-30 | Tergitol 15-S-30 |
| Nonionic surfactant[j] | 0.6 | 1.2 | 0.6 | 1.2 | 1.2 | 1.2 | 1.2 |
| Silicone co-softener[k] | 0.0 | 0.0 | 0.0 | 0.0 | 0.0 | 0.0 | 0.0 |
| Perfume oil | 0.52 | 0.52 | 0.52 | 0.52 | 0.52 | 0.52 | 0.52 |
| Ratio quaternary ammonium FSA/nonionic surfactant | 12.1 | 6.0 | 12.1 | 6.0 | 5.8 | 6.0 | 5.2 |
| Viscosity after 24 hr [cP][l] | 74 | 66 | 130 | 146 | 103 | 32 | 32 |
| Viscosity after F/T cycle [cP][m] | 1980 | 1460 | 1784 | 1178 | 113 | 96 | 48 |

| | (Weight percent) | | | | | | |
|---|---|---|---|---|---|---|---|
| | Ex 15 | Ex 16 | Ex 17 | Ex 18* | Ex 19* | Ex 20* | Ex 21* |
| Dispersion created using the process parameters from Table 1 | B | D | C | A | A | A | A |
| DI water | Balance | Balance | Balance | Balance | Balance | Balance | Balance |
| NaHEDP | 0.0064 | 0.0064 | 0.0064 | 0.0064 | 0.0064 | 0.0064 | 0.0064 |
| Formic acid | 0.040 | 0.040 | 0.040 | 0.041 | 0.040 | 0.040 | 0.040 |
| HCI | 0.0081 | 0.0179 | 0.0179 | 0.0181 | 0.0180 | 0.0180 | 0.0180 |
| Preservative[a] | 0.020 | 0.020 | 0.020 | 0.020 | 0.020 | 0.020 | 0.020 |
| FSA1[b] | 6.9 | 0.0 | 0.0 | 0.0 | 0.0 | 0.0 | 0.0 |
| FSA2[c] | 0.0 | 0.0 | 6.3 | 0.0 | 0.0 | 0.0 | 0.0 |
| FSA3[d] | 0.0 | 0.0 | 0.0 | 7.2 | 7.2 | 7.2 | 7.2 |
| FSA4[e] | 0.0 | 7.2 | 0.0 | 0.0 | 0.0 | 0.0 | 0.0 |
| FSA5[f] | 0.0 | 0.0 | 0.0 | 0.0 | 0.0 | 0.0 | 0.0 |
| Antifoam[g] | 0.091 | 0.091 | 0.091 | 0.092 | 0.091 | 0.091 | 0.091 |
| coconut oil | 0.24 | 0.24 | 0.00 | 0.00 | 0.00 | 0.00 | 0.00 |
| CaCl2 | 0.00 | 0.02 | 0.01 | 0.02 | 0.02 | 0.02 | 0.02 |
| Isopropanol | 0.71 | 0.71 | 0.00 | 0.00 | 0.00 | 0.00 | 0.00 |
| Encapsulated perfume[h] | 0.19 | 0.19 | 0.19 | 0.14 | 0.14 | 0.14 | 0.14 |
| Dye1 | 0.0100 | 0.0100 | 0.0100 | 0.0100 | 0.0100 | 0.0100 | 0.0100 |
| Dye2 | 0.0000 | 0.0000 | 0.0000 | 0.0000 | 0.0000 | 0.0000 | 0.0000 |
| Polymeric thickener[i] | 0.15 | 0.15 | 0.15 | 0.15 | 0.15 | 0.15 | 0.15 |
| Glycerol | 7.6 | 7.6 | 7.6 | 7.6 | 7.6 | 7.6 | 7.6 |
| Nonionic surfactant type | Tergitol NP-30 | Tergitol NP-30 | Tergitol NP-30 | Tergitol 15-S-7 | Tergitol 15-S-7 | Tergitol 15-S-15 | Tergitol NP-15 |
| Nonionic surfactant[j] | 1.2 | 1.2 | 1.2 | 0.6 | 1.2 | 1.2 | 1.2 |
| Silicone co-softener[k] | 0.0 | 0.0 | 0.0 | 0.0 | 0.0 | 0.0 | 0.0 |
| Perfume oil | 0.52 | 0.52 | 0.52 | 0.52 | 0.52 | 0.52 | 0.52 |
| Ratio quaternary ammonium FSA/nonionic surfactant | 5.8 | 6.0 | 5.2 | 12.1 | 6.0 | 6.0 | 6.0 |
| Viscosity after 24 hr [cP][l] | 109 | 31 | 31 | 104 | 125 | 66 | 60 |
| Viscosity after F/T cycle [cP][m] | 100 | 81 | 43 | 1020 | 998 | 1020 | 986 |

TABLE 2-continued

Fabric enhancer composition Examples 1 through 24. The examples marked with an asterisk are comparative examples.

| | (Weight percent) | | |
|---|---|---|---|
| | Ex 22* | Ex 23 | Ex 24 |
| Dispersion created using the process parameters from Table 1 | E | G | C |
| DI water | Balance | Balance | Balance |
| NaHEDP | 0.0060 | 0.0064 | 0.0064 |
| Formic acid | 0.021 | 0.040 | 0.040 |
| HCl | 0.0253 | 0.0225 | 0.0180 |
| Preservative[a] | 0.030 | 0.020 | 0.020 |
| FSA1[b] | 0.0 | 0.0 | 0.0 |
| FSA2[c] | 6.7 | 7.2 | 0.0 |
| FSA3[d] | 0.0 | 0.0 | 0.0 |
| FSA4[e] | 0.0 | 0.0 | 0.0 |
| FSA5[f] | 0.0 | 0.0 | 7.2 |
| Antifoam[g] | 0.085 | 0.091 | 0.091 |
| coconut oil | 0.00 | 0.00 | 0.00 |
| CaCl2 | 0.01 | 0.02 | 0.00 |
| Isopropanol | 0.00 | 0.00 | 0.00 |
| Encapsulated perfume[h] | 0.08 | 0.14 | 0.14 |
| Dye1 | 0.0167 | 0.0100 | 0.0100 |
| Dye2 | 0.0015 | 0.0000 | 0.0000 |
| Polymeric thickener[i] | 0.20 | 0.15 | 0.25 |
| Glycerol | 11.4 | 7.6 | 7.6 |
| Nonionic surfactant type | Solvapol N247 | Genapol X407 | Tergitol 15-S-30 |
| Nonionic surfactant[j] | 0.9 | 1.2 | 1.2 |
| Silicone co-softener[k] | 2.1 | 0.0 | 0.0 |
| Perfume oil | 0.56 | 0.52 | 0.52 |
| Ratio quaternary ammonium FSA/nonionic surfactant | 7.5 | 6.0 | 5.4 |
| Viscosity after 24 hr [cP][l] | 234 | 66 | 21 |
| Viscosity after F/T cycle [cP][m] | 4360 | 69 | 26 |

[a]Proxel GXL, 20% aqueous dipropylene glycol solution of 1,2-benzisothiazolin-3-one, supplied by Lonza. This material is part of the dispersion that is made per the process parameters of Table 1 and is not added at another point in the process.

[b]N,N-bis(hydroxyethyl)-N,N-dimethyl ammonium chloride fatty acid ester. This material is part of the dispersion that is made per the process parameters of Table 1 and is not added at another point in the process. The iodine value of the parent fatty acid of this material is about 20. The material as obtained from Evonik contains impurities in the form of free fatty acid, the monoester form of N,N-bis(hydroxyethyl)-N,N-dimethyl ammonium chloride fatty acid ester, and fatty acid esters of N,N-bis(hydroxyethyl)-N-methylamine.

[c]isomers of bis-(2-hydroxypropyl)-dimethylammonium methylsulfate fatty acid ester. This material is part of the dispersion that is made per the process parameters of Table 1 and is not added at another point in the process. The iodine value of the parent fatty acid is about 20. The material as obtained from Evonik contains impurities in the form of free fatty acid, the monoester form of bis-(2-hydroxypropyl)-dimethylammonium methylsulfate fatty acid ester, and fatty acid esters of bis-(2-hydroxypropyl)-methylamine.

[d]isomers of bis-(2-hydroxypropyl)-dimethylammonium methylsulfate fatty acid ester. This material is part of the dispersion that is made per the process parameters of Table 1 and is not added at another point in the process. The iodine value of the parent fatty acid is about 36. The material as obtained from Evonik contains impurities in the form of free fatty acid, the monoester form of bis-(2-hydroxypropyl)-dimethylammonium methylsulfate fatty acid ester, and fatty acid esters of bis-(2-hydroxypropyl)-methylamine.

[e]N,N-bis(hydroxyethyl)-N,N-dimethyl ammonium methylsulfate fatty acid ester. This material is part of the dispersion that is made per the process parameters of Table 1 and is not added at another point in the process. The iodine value of the parent fatty acid is about 20. The material as obtained from Evonik contains impurities in the form of free fatty acid, the monoester form of N,N-bis(hydroxyethyl)-N,N-dimethyl ammonium methylsulfate fatty acid ester, and fatty acid esters of N,N-bis(hydroxyethyl)-N-methylamine.

[f]Stepantex VK90, supplied by Stepan Company, paste of 10% isopropanol and 90% methyl bis[ethyl(tallowate)]-2-hydroxyethylammonium methylsulfate. As received from the supplier, Stepantex VK90 contains also a fraction of the mono-ester and tri-ester form of methyl bis[ethyl(tallowate)]-2-hydroxyethylammonium methylsulfate. This material is part of the dispersion that is made per the process parameters of Table 1 and is not added at another point in the process.

[g]MP10 ®, supplied by Dow Corning, 8% activity

[h]as described in U.S. Pat. No. 8,765,659, expressed as 100% encapsulated perfume oil

[i]Rheovis® CDE, cationic polymeric thickener supplied by BASF

[j]The nonionic level is calculated based on 100% activity.

[k]Xiameter MEM-0346, 60% polydimethylsiloxane activity, supplied by Dow Corning

[l]Brookfield® DV-E viscosity in cP, at 60 rpm, at about 20° C., 24 hours after making

[m]Brookfield® DV-E viscosity in cP, at 60 rpm, at about 20° C., after a freeze-thaw cycle

TABLE 3

| examples of ethoxylated nonionic surfactants | | |
|---|---|---|
| Ethoxylated nonionic surfactant | Supplier | average # ethylene oxide groups according to the supplier's literature |
| Emulan HE 50 | BASF | 5 |
| Lorodac 7-26 | Sasol | 7 |
| Tergitol 15-S-7 | The Dow Chemical Company | 7 |
| Tergitol NP-7 | The Dow Chemical Company | 7 |
| Lialet 123-8 | Sasol | 8 |
| Marlipal 1618/9 | Sasol | 9 |
| Solvapol N247 | Zavod Syntanolov | 10 |
| Tergitol NP-15 | The Dow Chemical Company | 15 |
| Tergitol 15-S-15 | The Dow Chemical Company | 15 |
| Genapol T150 | Clariant | 15 |
| Lorodac 20-24 | Sasol | 20 |
| Genapol T250 | Clariant | 25 |
| Tergitol NP-30 | The Dow Chemical Company | 30 |
| Tergitol 15-S-30 | The Dow Chemical Company | 30 |
| Genapol X307 | Clariant | 30 |
| Genapol X407 | Clariant | 40 |

Compositions with a viscosity higher than 700 cP after a freeze-thaw (F/T) cycle can be considered not fit for use anymore as these high viscosities can result in inaccurate and messy dosing as well as dispenser residues in the washing machine. Example 3 does not contain perfume and has a viscosity after a F/T cycle of 20 cP which is far below 700 cP. However, perfume is desired to be present in the composition to provide the fabric enhancer composition with a pleasant smell and/or a functional benefit, for example, malodor control, stress reduction and/or mood enhancement. Example 2 is similar to Example 3 but contains perfume oil and encapsulated oil to provide a pleasant smell. However, Example 2 shows that the F/T stability is lost by the presence of this perfume system.

Compositions according to the invention (Examples 5, 6, 12, 13, 14, 15, 16, 17, 23, 24) contain perfume oil, encapsulated perfume, and nonionic surfactant of formula A or B and have viscosities after a F/T cycle far below this threshold of 700 cP. Examples 5, 12, 13, 14, and 24 illustrate that the F/T stability is maintained with different quaternary ammonium ester fabric softening actives.

Comparative Examples 1, 2, 4, and 22 show that the nonionic surfactant Solvapol N247 (on average 10 ethylene oxide groups) outside the scope of the invention can result in F/T stability as shown in Example 1, but the F/T stability is lost when Solvapol N247 is used in combination with other quaternary ammonium ester fabric softening actives (Examples 2, 4, 22). Thus, in contrast to Applicants' invention, the comparative Examples 1, 2, 4, 8, 9, 10, 11, 18, 19, 20, 21, and 22 demonstrate that formulations comprising nonionic surfactants with on average less than about 30 ethylene oxide groups are not broadly freeze-thaw stable.

Example 5 and comparative Example 7 shows that when the ratio of quaternary ammonium ester fabric softening active to nonionic surfactant level is less than 7:1, F/T stability can be maintained.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric enhancer composition having a viscosity of from 20 cP to 700 cP and a pH of from about 1 to about 5 said fabric enhancer composition comprising, based on total composition weight:

a) from about 3% to about 20% of a quaternary ammonium ester fabric softening active, said quaternary ammonium ester fabric softening active comprising isomers of bis-(2-hydroxypropyl)-dimethylammonium methylsulfate fatty acid ester;

b) from about 0.01% to about 30% of an alcohol comprising from 1 to 7 carbons, said alcohol comprising glycerol; and c) from about 0.1% to about 10% of a perfume delivery system and/or from about 0.1% to about 4% perfume;

d) a nonionic surfactant having Formula A:

Formula A

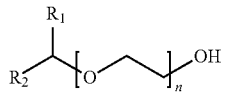

wherein n is on average from about 30 to 85, $R_1$ is hydrogen or an alkyl group comprising from 1 to 21 carbons; $R_2$ is an alkyl chain comprising from 1 to 22 carbon atoms, with the proviso that the sum of the total number of carbon atoms of $R_1$ and $R_2$ is from 9 to 22;

the ratio of quaternary ammonium ester softener active to nonionic surfactant being 1:1 to 7:1.

2. A fabric enhancer composition according to claim 1 wherein said quaternary ammonium ester fabric softening active further comprises a member selected from the group consisting of:

a) bis-(2-hydroxypropyl)-dimethylammonium methylsulfate fatty acid ester;

b) N,N-bis(hydroxyethyl)-N,N-dimethyl ammonium chloride fatty acid ester;

c) N,N-bis(hydroxyethyl)-N,N-dimethyl ammonium methylsulfate fatty acid ester; and d) N,N,N-tri(2-hydroxyethyl)-N-methyl ammonium methylsulfate fatty acid ester;

said quaternary ammonium ester fabric softening active comprising a fatty acid ester moiety having 12 to 22 carbons and being saturated or unsaturated, and substituted or unsubstituted.

3. A fabric enhancer composition according to claim 1 wherein a parent fatty acid moiety of said quaternary ammonium ester fabric softening active is:

a) saturated, substituted and of animal origin;
b) saturated, substituted and of vegetable origin;
c) saturated, unsubstituted and of animal origin;
d) saturated, unsubstituted and of vegetable origin;
e) unsaturated, substituted and of animal origin;
f) unsaturated, substituted and of vegetable origin;
g) unsaturated, unsubstituted and of animal origin; or
h) unsaturated, unsubstituted and of vegetable origin.

4. A fabric enhancer composition according to claim 3, wherein said quaternary ammonium ester fabric softening active has an iodine value from 0 to about 60.

5. A fabric enhancer composition according to claim 1, wherein said perfume delivery system is selected from the group consisting of benefit agent delivery particles, pro-perfumes, polymer particles, functionalized silicones, polymer assisted delivery, molecule assisted delivery, fiber assisted delivery, amine assisted delivery, cyclodextrins, starch encapsulated accord, zeolite and inorganic carrier, and mixtures thereof.

6. A fabric enhancer composition according to claim 5, wherein said perfume delivery system comprises benefit agent containing delivery particles.

7. A fabric enhancer composition according to claim 6, wherein said perfume delivery system comprises two or more types of benefit agent containing delivery particles.

8. A fabric enhancer composition according to claim 1 comprising an adjunct material.

9. A fabric enhancer composition according to claim 1, said fabric enhancer composition having a viscosity of from 60 cP to 400 cP and a pH of from about 2 to about 4, said fabric enhancer composition comprising, based on total composition weight:

a) from about 6% to about 12% of said quaternary ammonium ester fabric softening active;
b) from about 2% to about 9% of said alcohol; and
c) from about 0.1% to about 10% of a perfume delivery system and/or from about 0.1% to about 4% perfume;
d) a nonionic surfactant having Formula A:

Formula A

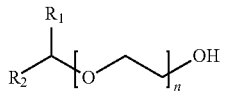

wherein n is on average from about 30 to 45; $R_1$ is an alkyl group comprising from 1 to 21 carbons; $R_2$ is an alkyl chain comprising from 1 to 22 carbon atoms, with the proviso that the sum of the total number of carbon atoms of $R_1$ and $R_2$ is from 9 to 22;

the ratio of quaternary ammonium ester softener active to nonionic surfactant being 2:1 to 13:2; and said fabric enhancer composition comprising, from 1.2% to about 2% of said nonionic surfactant.

10. A fabric enhancer composition according to claim 9 wherein said quaternary ammonium ester fabric softening active further comprises a member selected from the group consisting of:

a) bis-(2-hydroxypropyl)-dimethylammonium methylsulfate fatty acid ester;
b) N,N-bis(hydroxyethyl)-N,N-dimethyl ammonium chloride fatty acid ester;
c) N,N-bis(hydroxyethyl)-N,N-dimethyl ammonium methylsulfate fatty acid ester; and
d) N,N,N-tri(2-hydroxyethyl)-N-methyl ammonium methylsulfate fatty acid ester;

said quaternary ammonium ester fabric softening active comprising a fatty acid ester moiety having 12 to 22 carbons and being saturated or unsaturated, and substituted or unsubstituted.

11. A fabric enhancer composition according to claim 9 wherein the parent fatty acid moiety of said quaternary ammonium ester fabric softening active is:

a) saturated, substituted and of animal origin;
b) saturated, substituted and of vegetable origin;
c) saturated, unsubstituted and of animal origin;
d) saturated, unsubstituted and of vegetable origin;
e) unsaturated, substituted and of animal origin;
f) unsaturated, substituted and of vegetable origin;
g) unsaturated, unsubstituted and of animal origin; or
h) unsaturated, unsubstituted and of vegetable origin.

12. A fabric enhancer composition according to claim 9, wherein said perfume delivery system comprises two or more types of benefit agent containing delivery particles.

13. A fabric enhancer composition according to claim 9 comprising an adjunct material.

14. A fabric enhancer composition according to claim 1, wherein said fabric enhancer composition comprises, based on total composition weight, from 1.1% to about 5% of said nonionic surfactant.

15. A method of treating and/or cleaning a fabric, said method comprising a) optionally washing, rinsing and/or drying said fabric;
b) contacting said fabric with a fabric enhancer composition according to claim 1 and
c) optionally washing, rinsing and/or drying said fabric wherein said drying steps comprise active drying and/or passive drying.

16. A method of treating and/or cleaning a fabric, said method comprising a) optionally washing, rinsing and/or drying said fabric;
b) contacting said fabric with a fabric enhancer composition according to claim 9; and
c) optionally washing, rinsing and/or drying said fabric wherein said drying steps comprise active drying and/or passive drying.

* * * * *